US010945526B2

(12) United States Patent
Kareus

(10) Patent No.: US 10,945,526 B2
(45) Date of Patent: Mar. 16, 2021

(54) COLLAPSIBLE OUTDOOR SHELVING UNIT

(71) Applicant: Robert Kareus, Midland, MI (US)

(72) Inventor: Robert Kareus, Midland, MI (US)

( * ) Notice: Subject to any disclaimer, the term of this patent is extended or adjusted under 35 U.S.C. 154(b) by 0 days.

(21) Appl. No.: 16/905,021

(22) Filed: Jun. 18, 2020

(65) Prior Publication Data

US 2020/0337461 A1 Oct. 29, 2020

Related U.S. Application Data

(63) Continuation-in-part of application No. 16/394,169, filed on Apr. 25, 2019.

(51) Int. Cl.
*A47B 96/02* (2006.01)
*A47B 96/14* (2006.01)

(52) U.S. Cl.
CPC ..... *A47B 96/028* (2013.01); *A47B 96/1416* (2013.01); *A47B 2230/08* (2013.01)

(58) Field of Classification Search
CPC ..... A47B 13/023; A47B 2200/0021; E04H 12/2215
USPC ..... 108/150, 25, 26, 97, 96, 148; 248/530
See application file for complete search history.

(56) References Cited

U.S. PATENT DOCUMENTS 1,379,129 A * 5/1921 Sejnoha ..... A47C 9/10 108/166
1,733,001 A * 10/1929 Binger ..... A47F 5/06 108/92
1,956,956 A * 5/1934 Leibo ..... A47C 9/10 297/378.1
2,010,290 A * 8/1935 Campbell ..... A47C 3/285 108/148
2,520,450 A * 8/1950 Austin, Jr. ..... A45F 3/44 248/125.1
2,523,513 A * 9/1950 Oliver ..... A47C 3/28 248/158
2,720,249 A * 10/1955 Peterson ..... A47C 9/10 108/141
2,872,223 A * 2/1959 Shearman ..... A47C 3/285 403/104
2,990,068 A * 6/1961 Topel ..... F25D 25/02 108/139
3,112,928 A * 12/1963 Oswald ..... A61G 13/009 482/55
4,920,897 A * 5/1990 Reed ..... A47B 37/04 108/150
5,156,096 A 10/1992 Lamprey
5,427,344 A 6/1995 Beauchemin
6,467,843 B1 * 10/2002 Rossborough ..... A47C 3/34 108/150
6,487,977 B1 * 12/2002 Williams ..... A45B 23/00 108/150
7,641,156 B2 * 1/2010 Medders ..... A47G 25/12 248/125.8
8,763,539 B2 7/2014 Pena et al.
9,220,337 B1 * 12/2015 Wenzel ..... A47B 13/023
9,549,627 B1 * 1/2017 Grady ..... A47G 23/0208
(Continued)

*Primary Examiner* — Jose V Chen

(57) ABSTRACT

A collapsible, portable shelving unit that is useful within tents and the like when one is camping. The device is easy to pack and carry and is lightweight but will hold a fair amount of weight when in use. There is no requirement for supporting the shelving unit to posts or trees or the like, as the device is self-supportable, even when it contains various objects on the shelving. It is especially useful for tent camping.

3 Claims, 4 Drawing Sheets

(56) References Cited

U.S. PATENT DOCUMENTS

| | | | | |
|---|---|---|---|---|
| 2007/0246091 | A1* | 10/2007 | Becker | A47B 37/04 135/16 |
| 2008/0196636 | A1* | 8/2008 | Lawrence | A47B 13/023 108/150 |
| 2010/0163086 | A1* | 7/2010 | Chavez | A45B 3/00 135/16 |
| 2012/0132113 | A1* | 5/2012 | Unger | A47B 13/023 108/28 |
| 2014/0102337 | A1* | 4/2014 | Ralph | A47B 3/00 108/25 |
| 2015/0208634 | A1* | 7/2015 | Box | A01K 97/10 108/25 |

* cited by examiner

COLLAPSIBLE OUTDOOR SHELVING UNIT

This application is a Continuation-in-part of Utility patent application Ser. No. 16/394,169, filed Apr. 25, 2019, from which priority is claimed.

BACKGROUND OF THE INVENTION

This invention deals with a collapsible, portable shelving unit that is useful within tents and the like when one is camping. The device is easy to pack and carry and is lightweight but will hold a fair amount of weight when in use. There is no requirement for supporting the shelving unit to posts or trees or the like, as the device is self-supportable, even when it contains various objects on the shelving. It is especially useful for tent camping.

Various portable shelfing can be found in the art, for example, U.S. Pat. No. 5,427,344 that issued to Beauchemin on Jun. 27, 1995 deals with a portable handing shelf for attachment to vertical objects. This device requires the presence of a post or tree to allow it to be used.

U.S. Pat. No. 5,156,096, that issued to Lamprey on Oct. 20, 1992 deals with an anti-rotational outdoor shelf. This device also requires a post or tree to be used.

U.S. Pat. No. 8,763,539 that issue to Pena, et al on Jul. 1, 2014 deals with a kit for modular assembly of a piece of furniture.

None of these prior art references teach or suggest the device of the instant invention.

THE INVENTION

Thus, what is disclosed and claimed herein is a collapsible outdoor shelving unit. The unit comprises at least one shelf, wherein each shelf has a back edge, a top surface, a side surface and two ends.

There is a collapsible support shaft that has a top end and a bottom end. The top end terminates in a handle and the bottom end terminates in a pointed tip.

Each shelf has an opening near the back edge and is Essentially centered between the two ends of the shelf to allow entry of the shaft. There is a means of retaining each shelf on the shaft in a predetermined location on the shaft.

The retaining means can be any one of a friction grommet in the opening in each shelf, or, the shaft can be threaded in predetermined positions and then use threaded nuts, insertable threaded bolts, a shaft collar, a hex bolt through the side surface of the shelf to the shaft, and a hitch pin through the opening in the shelf side edge to the shaft, all of which will serve to hold the shelf in place.

In addition, other embodiments include a shaft that consists of one piece and a shaft that consists of two or more pieces.

DETAILED DESCRIPTION OF THE DRAWINGS

Figure 1:
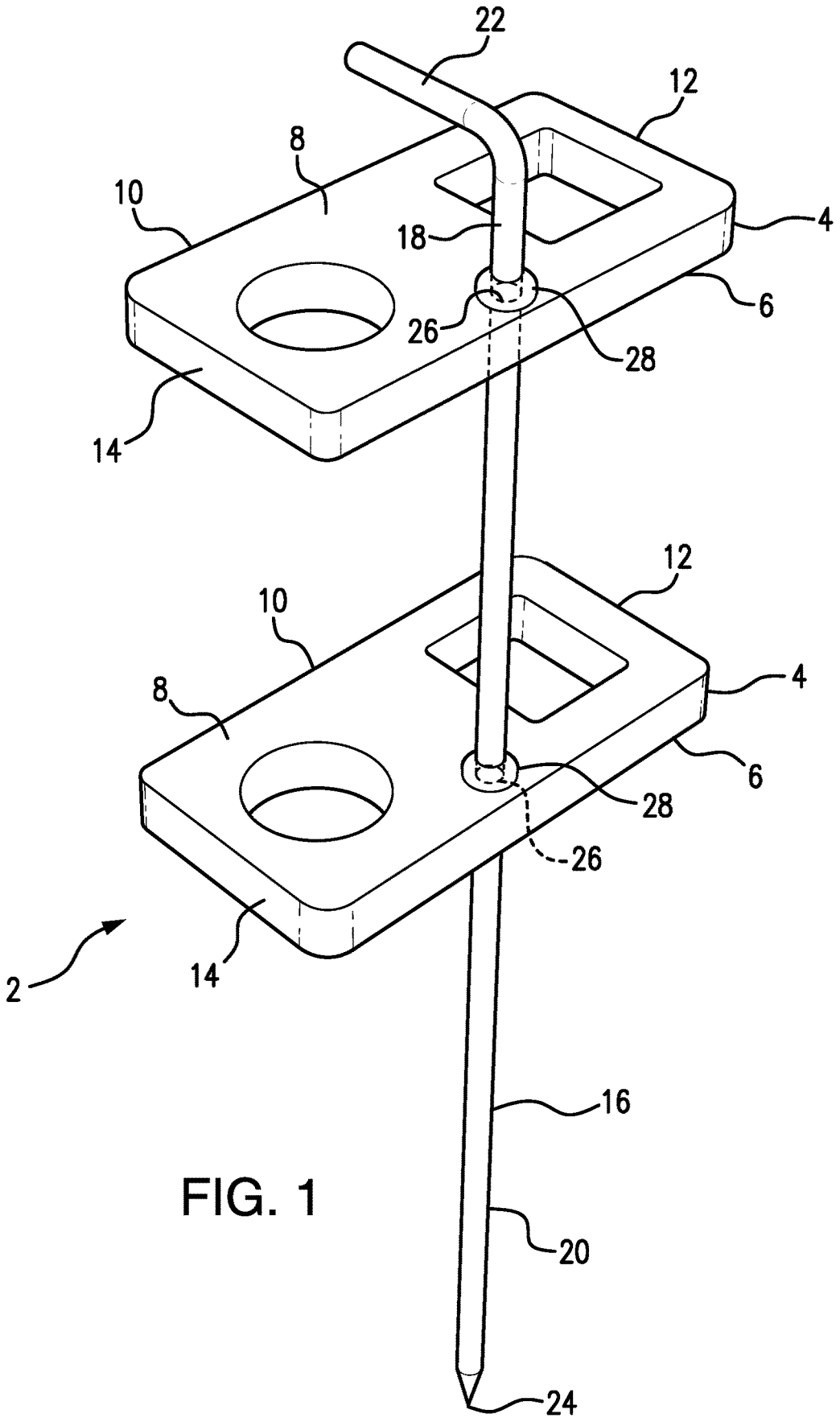
FIG. 1 is a view in perspective of a device of this invention showing two shelves and friction grommets as the retaining means for the shelves.

FIG. 1 is a view in perspective of the collapsible outdoor shelving 2 of this invention showing two shelves 4 and friction grommets 28 as the retaining means for the shelves 4. The shelves 4 have a back surface 6, a top surface 8 and a side surface 10. The shelves 4 also have a first end 12 and a second end 14.

There is also a support shaft 16 that has a top end 18 and a bottom end 20. The top end 18 terminates into a handle 22 and the bottom end terminates into a point 24.

Each shelf 4 has an opening 26 through it, near the back edge 6, and is essentially centered between the two ends 12 and 14 of the shelf 4 to allow entry of the shaft 16. There are various embodiments for a means of retaining the shelves 4 on the shaft 16.

Figure 2:
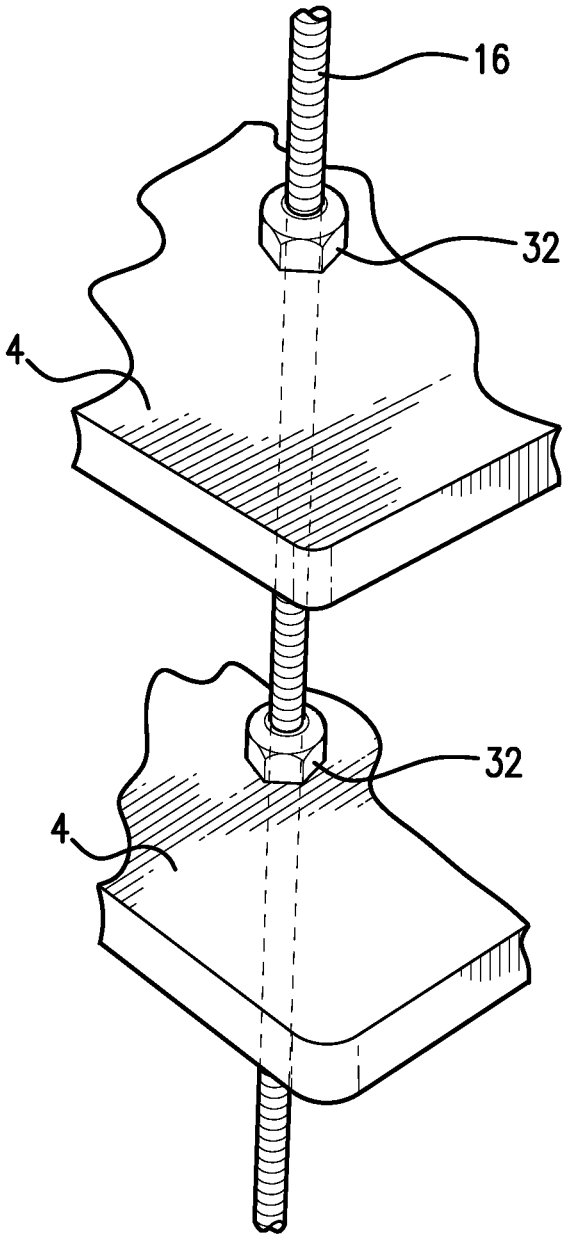
FIG. 2 shows the shaft is threaded in predetermined positions and the retaining means is threaded nuts.

FIG. 2 shows the shaft 16 as being threaded in predetermined positions and the retaining means are threaded nuts 32. The retaining means can be a threaded shaft with threaded nuts 32 that hold the shelves in place with respect to where the threaded nuts are positioned on the shaft 16.

Figure 3:
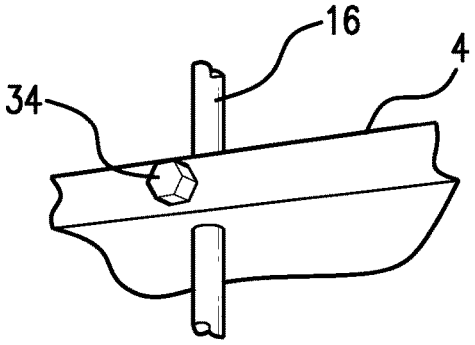
FIG. 3 is a partial view of a threaded insertable bolt as the retaining means.

FIG. 3 is a partial view of a threaded insertable bolt 34 as the retaining means. Here the shelves 4 are retained by the insertable threaded bolt 34 that is tightened against the shaft 16.

Figure 4:
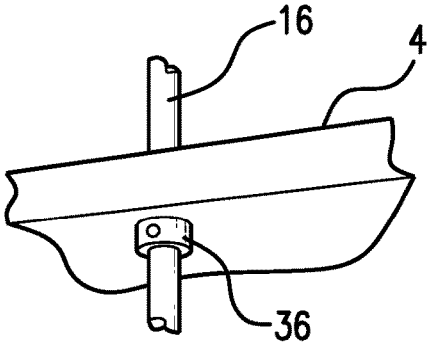
FIG. 4 is a partial view of a shaft collar as the retaining means.

FIG. 4 is a partial view of a shaft collar 36 as the retaining means. The shelves 4 are retained by the shaft collar 36 that is tightened against the shaft 16.

Figure 5:
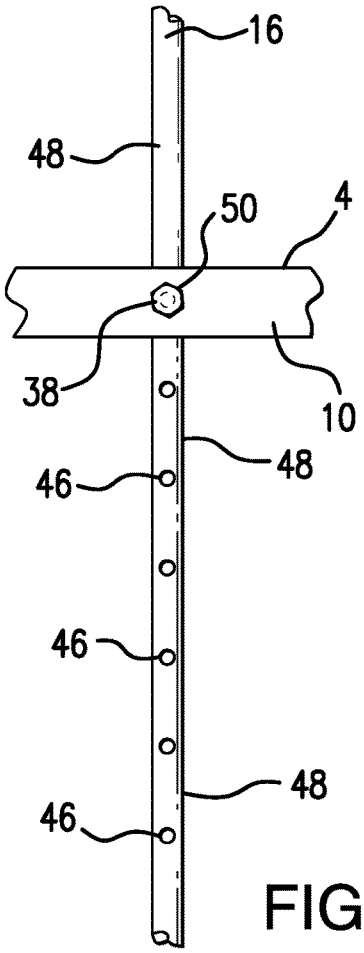
FIG. 5 shows a hex bolt through the side surface of the shelf to the shaft as the retaining means.

FIG. 5 shows a hex bolt 38 through the opening 50 through the side surface 10 of the shelf 4 to the shaft 16, as the retaining means. This embodiment also has openings 46 in the shaft and in the side surface of the shelf 4 to retain the shelf 4 with the hex bolt 38.

Figure 6:
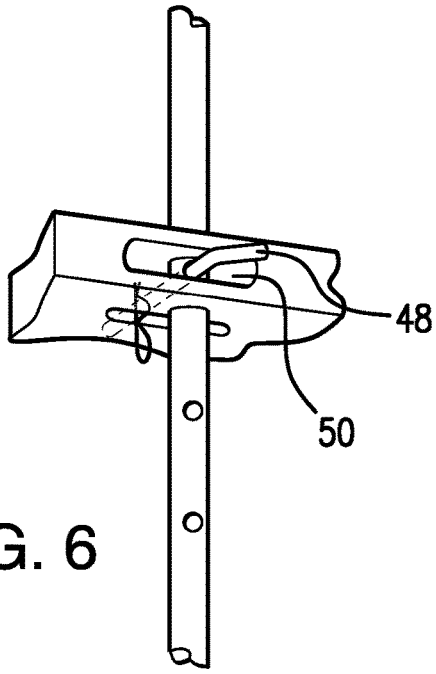
FIG. 6 shows a hitch pin through the opening in the shelf side edge to shaft as the retaining means.

FIG. 6 shows a hitch pin 40 through the opening 50 through the side surface 10 of the shelf 4 to the shaft 16 as the retaining means. The hitch pin 40 passes through the opening 50 through in the shelf side edge 10 to shaft 16 as the retaining means.

Figure 7A:
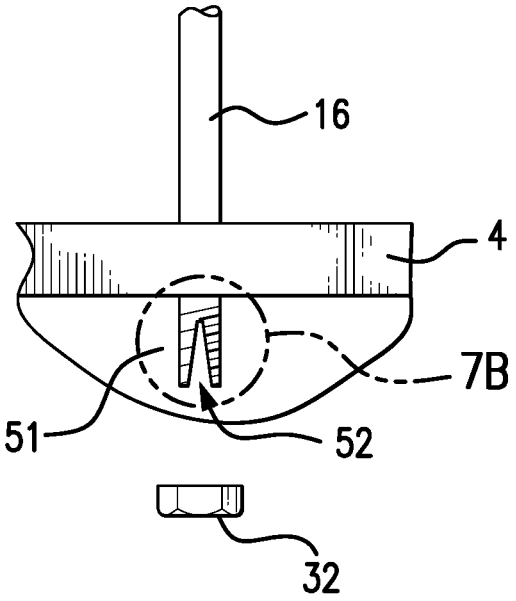
FIG. 7A is a full view of a compressible plastic post mounted on the bottom of the shelf.
Figure 7B:
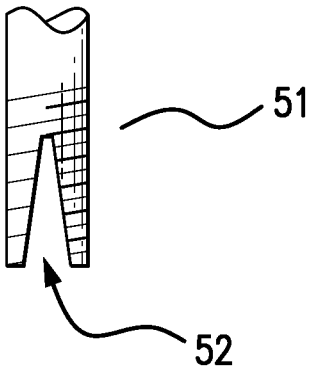
FIG. 7B is a full side view of a threaded nut that will fit unto the compressible plastic post of FIG. 7A.

Another form of fastening means for this invention is a compressible plastic post 51 shown in FIGS. 7A and 7B. Designation 3 is a threaded nut that fits the compressible plastic post 51 and compresses the post 51 as it is wound onto the compressible plastic post 51. This is possible because of the open slit 52 in the compressible plastic post 52. The compressible plastic post 52 can be molded in the bottom of the shelf 4 during molding of the shelf 4 or it can be a plug that is inserted in an opening prior to insertion of the post.

What is claimed is:

1. A collapsible outdoor shelving unit, said unit comprising:

at least one shelf, each said shelf having a back edge, a top surface, a side surface and two ends;

a collapsible support shaft, said collapsible support shaft having a top end and a bottom end, said top end terminating in a handle, said bottom end terminating in a pointed tip;

each said shelf having an opening near said back edge and essentially centered between said two ends of said shelf to allow entry of said shaft;

a retainer for each said shelf consisting of a threaded compressible sleeve and a threaded nut for said compressible sleeve wherein the compressible sleeve is molded into a bottom of said shelf.

2. A collapsible outdoor shelving unit as claimed in claim 1, wherein said shaft consists of one piece.

3. A collapsible outdoor shelving unit as claimed in claim 1, wherein said shaft consists of at least two pieces.

* * * * *